US009950208B2

(12) United States Patent
Willis

(10) Patent No.: US 9,950,208 B2
(45) Date of Patent: Apr. 24, 2018

(54) YOGA MAT SYSTEMS AND METHODS

(71) Applicant: Michael Allen Willis, Garden Grove, CA (US)

(72) Inventor: Michael Allen Willis, Garden Grove, CA (US)

( * ) Notice: Subject to any disclaimer, the term of this patent is extended or adjusted under 35 U.S.C. 154(b) by 0 days.

(21) Appl. No.: 15/479,156

(22) Filed: Apr. 4, 2017

(65) Prior Publication Data

US 2017/0266485 A1 Sep. 21, 2017

Related U.S. Application Data

(63) Continuation-in-part of application No. 14/470,815, filed on Aug. 27, 2014, now Pat. No. 9,610,472.

(51) Int. Cl.

| | |
|---|---|
| ***A47G 9/06*** | (2006.01) |
| ***A63B 21/00*** | (2006.01) |
| ***A63B 71/00*** | (2006.01) |

(52) U.S. Cl.

CPC ..... *A63B 21/4037* (2015.10); *A63B 71/0036* (2013.01); *A63B 2210/50* (2013.01); *A63B 2225/68* (2013.01)

(58) Field of Classification Search

CPC ..... A47G 9/06
USPC ..... 5/417–420
See application file for complete search history.

(56) References Cited

U.S. PATENT DOCUMENTS

| | | | | |
|---|---|---|---|---|
| 2,264,471 | A * | 12/1941 | Glenn | A47G 9/062 2/69 |
| 2,540,165 | A | 2/1951 | Fiel | |
| 4,154,323 | A | 5/1979 | Sneider | |
| 4,609,580 | A | 9/1986 | Rockett et al. | |
| D389,642 | S | 1/1998 | Nadel | |
| 6,640,359 | B1 | 11/2003 | Alane | |
| 6,641,196 | B1 | 11/2003 | Hanagan | |
| 6,742,635 | B2 | 6/2004 | Hirschberg | |
| 6,751,816 | B1 | 6/2004 | Wechsler | |
| 7,108,635 | B2 | 9/2006 | Howlett-Campanella | |
| D530,512 | S | 10/2006 | Palaszek | |
| D554,208 | S | 10/2007 | Palaszek | |
| D565,339 | S | 4/2008 | Gunnarsson | |
| D572,068 | S | 7/2008 | Lin | |
| D584,093 | S | 1/2009 | Drumm | |
| D589,289 | S | 3/2009 | Laure | |
| D599,149 | S | 9/2009 | White | |
| 7,955,224 | B2 | 6/2011 | Curley | |
| D646,517 | S | 10/2011 | Noonan | |
| 8,075,464 | B2 | 12/2011 | Hayes et al. | |
| D653,894 | S | 2/2012 | Kieffer | |
| D657,987 | S | 4/2012 | Lane | |
| D660,068 | S | 5/2012 | Wang | |
| 8,192,330 | B2 | 6/2012 | Curley | |
| 8,317,660 | B2 | 11/2012 | Goranson | |
| D671,784 | S | 12/2012 | Gallie, II | |
| D674,226 | S | 1/2013 | Greenwald | |
| D678,703 | S | 3/2013 | Ntoukas | |
| D688,068 | S | 8/2013 | Ntoukas | |
| 8,510,878 | B2 | 8/2013 | Wang | |
| 8,607,381 | B2 | 12/2013 | Woods et al. | |
| D698,187 | S | 1/2014 | Kazarska et al. | |

(Continued)

*Primary Examiner* — Frederick C Conley
(74) *Attorney, Agent, or Firm* — Robert D. Buyan; Stout, Uxa & Buyan, LLP

(57) ABSTRACT

A system comprising a yoga mat, storage compartment and carrying case and associated methods for use.

12 Claims, 9 Drawing Sheets

(56) References Cited

U.S. PATENT DOCUMENTS

| | | | | |
|---|---|---|---|---|
| D699,979 | S | 2/2014 | Tamayo | |
| D699,980 | S | 2/2014 | Tamayo | |
| D702,970 | S | 4/2014 | Coco | |
| 2004/0250346 | A1 | 12/2004 | Vasishth | |
| 2005/0172402 | A1 | 8/2005 | Uretzky-Miller | |
| 2005/0192158 | A1 | 9/2005 | Edwards | |
| 2006/0073305 | A1 | 4/2006 | Kole | |
| 2007/0275827 | A1 | 11/2007 | Glaser | |
| 2008/0127414 | A1 | 6/2008 | Allen | |
| 2009/0078662 | A1 | 3/2009 | Boehm Clifton | |
| 2009/0178267 | A1 | 7/2009 | Axelrod | |
| 2009/0241260 | A1 | 10/2009 | Noonan | |
| 2009/0260157 | A1 | 10/2009 | Gere | |
| 2010/0267535 | A1 | 10/2010 | Kieffer | |
| 2012/0076981 | A1 | 3/2012 | Franks et al. | |
| 2012/0304382 | A1 | 12/2012 | Sole | |
| 2012/0324645 | A1 | 12/2012 | Lehr | |
| 2013/0042408 | A1 | 2/2013 | Sun | |
| 2013/0180048 | A1 | 7/2013 | Saltzman | |
| 2014/0069970 | A1* | 3/2014 | Thomas, Jr. ..... | A45F 3/14<br>224/257 |

* cited by examiner

YOGA MAT SYSTEMS AND METHODS

RELATED APPLICATIONS

This is a continuation in part of U.S. patent application Ser. No. 14/470,815 filed Aug. 27, 2014 and issuing on Apr. 4, 2017 as U.S. Pat. No. 9,610,472, the entire disclosure of such application and patent being expressly incorporated herein by reference.

Field of the Invention

The present invention relates generally to the fields of exercise, meditation and holistic health and more particularly to yoga mats used in the practice of yoga.

BACKGROUND OF THE INVENTION

Pursuant to 37 CFR 1.71(e), this patent document contains material which is subject to copyright protection and the owner of this patent document reserves all copyright rights whatsoever.

Various types of styles of yoga have existed and been practiced over the years. The modern-day practice of toga in Western cultures typically involves physical postures or poses, breathing control techniques, and meditation. Commonly, a group of persons may gather in a single room to practice yoga under the lead of an instructor (sometimes referred to as a "yogacharya"). It is typical for each person in the room to sit or stand on an individual yoga mat throughout each yoga session. While some yoga studios do make lockers available for storage of personal items cell phones, keys, sun glasses and yoga mat carrying bags, it is not unusual for persons to eschew use of such lockers, opting instead to place such personal items on the floor near their yoga respective yoga mats. Also, individuals often wish to have work out towels with them while practicing yoga and such towels are commonly placed on the floor along with their other items of personal property. Such items lying on the floor can be unsightly and/or may present a slip-and-fall hazard.

A standard yoga mat typically comprises a sheet of foamed or solid elastomeric material (e.g., polyvinyl chloride (PVC)) having a thickness in the range of about ⅙ inch to about ¼ inch. In some more complex yoga mats, a plurality of layers of different material are used. For example, yoga mats sold for use in hot yoga or Bikram yoga may have an absorbent upper layer (e.g., terry cloth material) permanently affixed to an elastomeric mat lower layer such that the elastomeric lower layer will contact the underlying floor while the yoga practitioner sits/stands on the towel-like upper layer. The towel like upper layer may then absorb perspiration. One commercially available example is the Breath TM Yoga Mat marketed by Breathe Yoga Mats or Vancouver, British Columbia which has a cotton terry top layer, a middle layer of absorbent cushioning fibers and a coated, brushed bottom layer for gripping the underlying floor surface. However, the multi-layer yoga mats of the prior art have typically not been designed to permit periodic detachment and laundering of the upper perspiration-absorbing layer.

The prior art has also included various other purported improvements and accessories relating to yoga mats, including those described in: U.S. Pat. No. 8,607,381 entitled Yoga Mat; U.S. Pat. No. 8,317,660 entitled Yoga Mat with Pose Markings; U.S. Pat. No. 8,192,330 entitled Yoga Mat with Intuitive Tactile for Visually Impaired; U.S. Pat. No. 7,955, 224 entitled Yoga Mat with Intuitive Tactile Feedback for Visually Impaired; U.S. Pat. No. 7,108,635 entitled Yoga Mat with Body Contact Placement Indicia; U.S. Pat. No. 6,640,359 entitled Yoga Mat; U.S. Pat. No. 6,491,196 entitled Yoga Mat Holder, United States Patent Application Publication Nos. 2014/0069970 entitled Yoga Mat Carrying Bag Assembly; 2013/0180048 entitled Exercise Yoga Mat and Method of Using Same; 2013/0042408 entitled Smart Fold Yoga Mat; 2012/0324645 entitled Yoga Mat Incorporating Non-Slip Positioning Pads; 2012/0210512 entitled Yoga Mat; 2012/0076981 entitled Yoga Mat with Support and Traction; 2011/0118097 entitled Yoga Mat with Intuitive Tactile Feedback for Visually Impaired; 2011/0111926 entitled Yoga Mat with Pose Markings; 2010/00267535 entitled Yoga Mat; 2009/0241260 entitled Yoga Mat; 2009/0178267 entitled ID Clip for Yoga Mat; 2009/0078662 entitled Yoga Mat Storage Racks; 2009/0062076 entitled Yoga Mat with Intuitive Tactile Feedback for Visually Impaired; 2007/0275827 entitled Yoga Mat; 2006/0073305 entitled Yoga Mat; 2005/0172402 Yoga Mat Carry Bag; 2004/0250346 entitled Anti-Slip Multi-Layer Yoga Mat; 2001/0034288 Yoga Mat with Body Contact Placement Indicia and the designs shown in United States Design Patent Nos. D702970; D699980; D699979; D698187; D688068; D678703; D674226; D671784; D660068; D657987; D653894; D646517: D599149; D589289; D584093: D572068; D565339; D554208; D530512 and D389642. The entire disclosure of each of the patents and patent applications listed in this paragraph is expressly incorporated herein by reference.

SUMMARY OF THE INVENTIONS

The present invention provides yoga mats which have storage compartment(s) (e.g., one or more pockets, pouches, boxes, etc.) useable for storage of personal items.

The present invention also provides yoga mats having upper layers (e.g., fabric or perspiration absorbing material) which are detachable from underlying layer(s) of the may so as to be periodically laundered or replaced.

In accordance with the invention, there is further provided a system which generally comprises: a) a yoga mat; b) a storage compartment; and c) a carrying case. The storage compartment is alternately attachable to and detachable from the yoga mat. The carrying case is alternately deployable in a collapsed configuration or a non-collapsed configuration. The carrying case is positionable in the storage compartment while the carrying case is in a collapsed configuration. The yoga mat is alternately deployable in a non-collapsed configuration (e.g, flat on a floor) or a collapsed configuration (e.g., rolled up or folded). Thus, the yoga mat may be placed on a flat surface such as a floor when the yoga mat is in a non-collapsed configuration. The yoga mat is alternatively positionable in the carrying case, along with the storage compartment, when the yoga mat is in a collapsed configuration.

Further in accordance with the invention, there is provided a method for using a system of the above-summarized character, such method comprising the steps of: said method comprising the steps of: a) deploying the yoga mat on a flat surface with the yoga mat in a non-collapsed configuration; b) attaching the storage compartment to the yoga mat; and c) placing the carrying case in a collapsed configuration within the storage compartment. Optionally, one or more additional items (e.g., personal or sundry items such as keys, glasses, cell phone, etc.) may be placed in the storage compartment along with the collapsed carrying case. After use of the yoga mat has been completed, the method may proceed by the steps of: d) removing the carrying case from the storage compartment; e) transitioning the carrying case from a collapsed configuration to a non-collapsed configuration; f) transitioning the yoga mat from a non-collapsed configuration to a collapsed configuration; and g) placing the yoga mat and storage compartment in the carrying case. If any additional items (e.g., personal or sundry items) were placed in the storage compartment, some or all of such additional items may be removed or allowed to remain in the storage compartment when it is stowed in the carrying case provided that they do not prevent the storage compartment from fitting in the carrying case. In some embodiments, the storage compartment may also be collapsible (e.g., foldable) and may be disposed in a collapsed (e.g., folded or jumbled) configuration before being placed in the carrying case.

Further aspects and details of the present invention will be understood upon reading of the detailed description and examples set forth herebelow.

BRIEF DESCRIPTION OF THE DRAWINGS

The following detailed description and examples are provided for the purpose of non-exhaustively describing some, but not necessarily all, examples or embodiments of the invention, and shall not limit the scope of the invention in any way.

In FIG. 6A, the yoga mat is deployed on a floor surface with the storage compartment attached to the yoga mat and the carrying case contained, in a collapsed configuration, within the storage compartment. I FIG. 6B, the storage compartment is opened, the carrying case is removed and transitioned to a non-collapsed configuration. In FIG. 6C the storage compartment is optionally detached from the yoga mat, the yoga mat is collapsed (e.g., rolled) and both the yoga mat and storage compartment are inserted into the open carrying case. In FIG. 6D the carrying case is closed, with the yoga mat and detachable storage compartment contained within the carrying case, such that the entire system may be carried, transported or stored by a user.

DETAILED DESCRIPTION OF THE INVENTION

The following detailed description and the accompanying drawings to which it refers are intended to describe some, but not necessarily all, examples or embodiments of the invention. The described embodiments are to be considered, in all respects, as only illustrative and not restrictive. The contents of this detailed description and the accompanying drawings do not limit the scope of the invention in any way.

Figure 1:
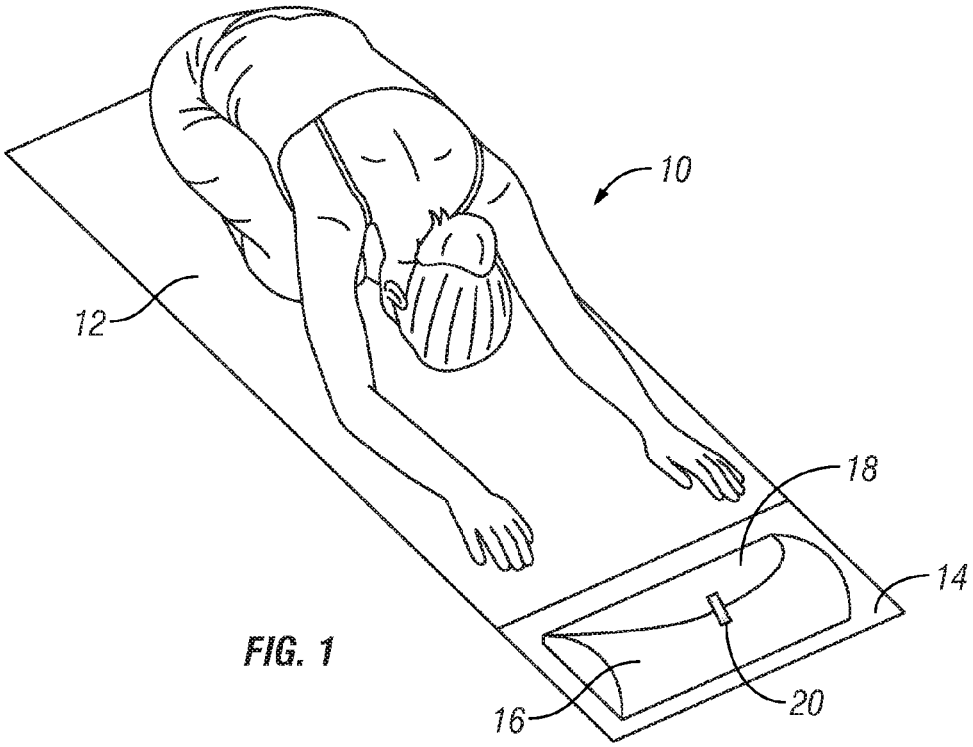
FIG. 1 is a perspective view of one example of a yoga mat which incorporates a storage compartment in accordance with the present invention.
Figure 1A:
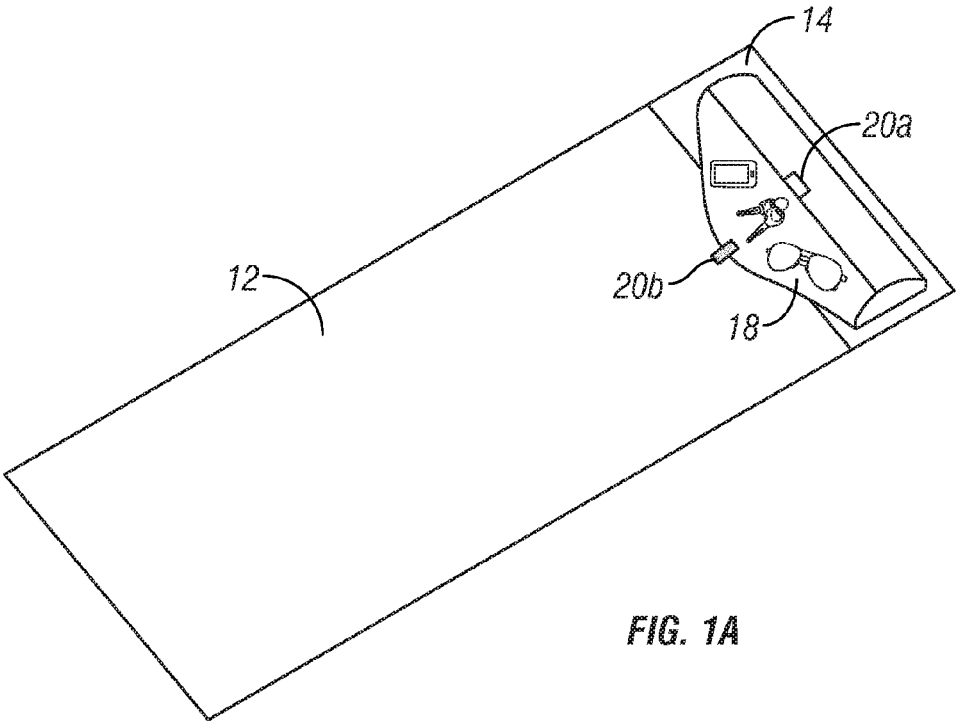
FIG. 1A is another perspective view of the yoga mat of FIG. 1 with its storage compartment closure flap in an open position exposing various items stored within the storage compartment.

FIGS. 1 and 1A show one example of a yoga mat device 10 of the present invention. In this example, the yoga mat device 10 comprises a yoga mat 12 having a storage compartment 14 attached to one end of the mat 12. The storage compartment in this example comprises a flat base panel having a flexible pouch 16 mounted thereon. The pouch 16 may include a closure flap 18 with an optional flap retaining apparatus 20 which retains positioning of the closure flap 18 when in the closed position as seen in FIG. 1. As shown in FIG. 1A, the flap retaining apparatus 20 may comprise a first member 20*b* on the flap 18 which is alternately engageable with and disengageable from a second member 20*b* on the wall of the pouch 16. Disengagement of the first member 20*a* from the second member 20*b* allows the closure flap 18 to be moved to an open position as illustrated in FIG. 1A.

Figure 2:
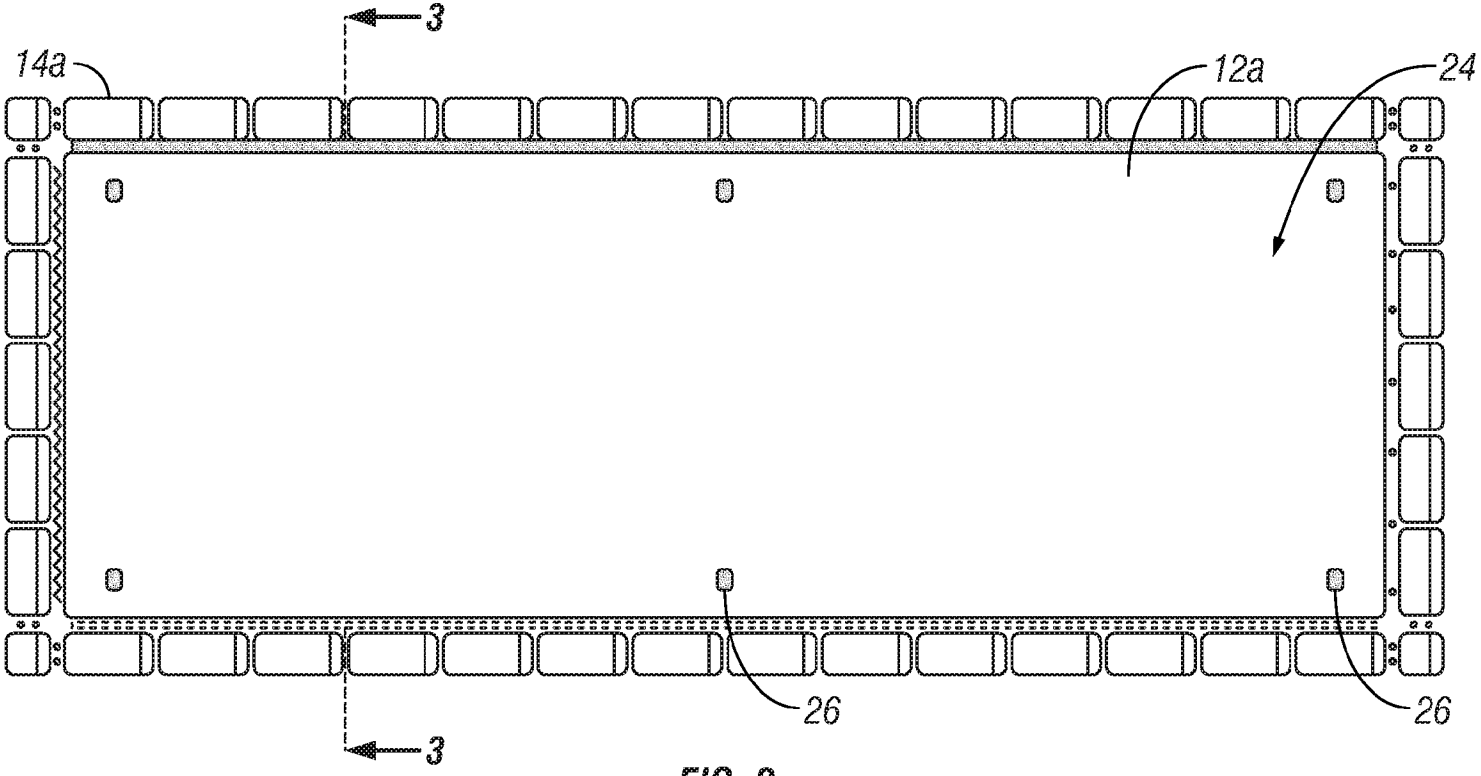
FIG. 2 is a top view of another example of a yoga mat of the present invention incorporating a plurality of storage compartments as well as a removable upper layer which may comprise soft or towel-like fabric or other suitable material.
Figure 2A:
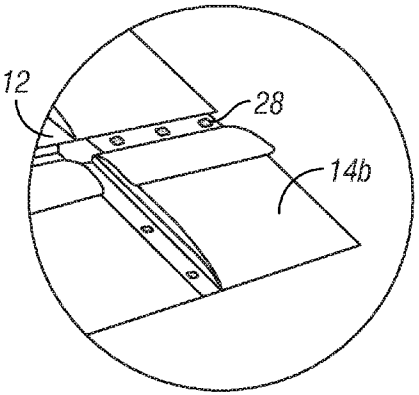
FIG. 2A is a diagram showing an example of a storage compartment attached to a yoga mat by way of snaps in accordance with the present invention.

It is to be appreciated that any number of storage compartment(s) 14, which may be of the same or differing size and/or type, may be permanently or detachably attached to some of all ends and/or sides of the yoga mat. In an illustrative example, FIG. 2 shows a yoga mat device which comprises a yoga mat 12*a* having numerous storage compartments 14*a* of varying size and/or type attached to both ends and both sides of the yoga mat 12*a* so that the entire yoga mat is substantially surrounded by storage compartments.

It is to be further appreciated that the yoga mat 12 may be of any suitable construction or type, including any of the yoga may designs or constructions disclosed in the patents and patent applications referenced and incorporated by reference above. Optionally, regardless of the particular construction or design of the mat itself, a removable upper layer may be provided on the mat in accordance with the present invention. In this regard, the yoga mat 12*a* seen in FIGS. 2-3A includes an optional removable upper layer 24 that is attached to the mat by way of connectors 26. The removable upper layer 24 may comprise any suitable material, such as a disposable or washable material. Examples of suitable materials include but are not limited to soft or absorbent paper, polymer, fabric material (e.g., paper towel, cotton fabric, polyester fabric, terry fabric, fleece, Sherpa fleece, microfiber material, etc.). In embodiments where the removable upper layer 24 is intended to be disposed of rather than laundered, the user may remove, dispose of and replace the upper layer 24 when the upper layer 24 becomes soiled or otherwise in need of replacement. In embodiments where the upper layer 24 is formed of washable material intended to be laundered or otherwise cleaned, the user may remove, launder or otherwise clean and then reattach the upper layer 24. In embodiments that have a removable upper layer 24, such as a towel, one or more optional storage compartment (s), for example one or more pockets 25 as shown in dotted lines on FIG. 3A, may optionally be formed in that removable upper layer (e.g., towel). Such optional storage compartments such as pocket(s) 25, if present, may be of any suitable size or shape and may be appended or formed at any suitable location(s) on the removable upper layer 24.

Figure 3:
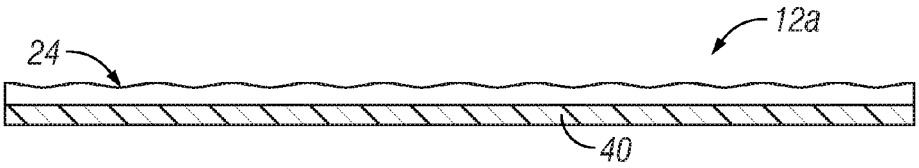
FIG. 3 is a cross-sectional view through line 3-3 of FIG. 2.
Figure 3A:
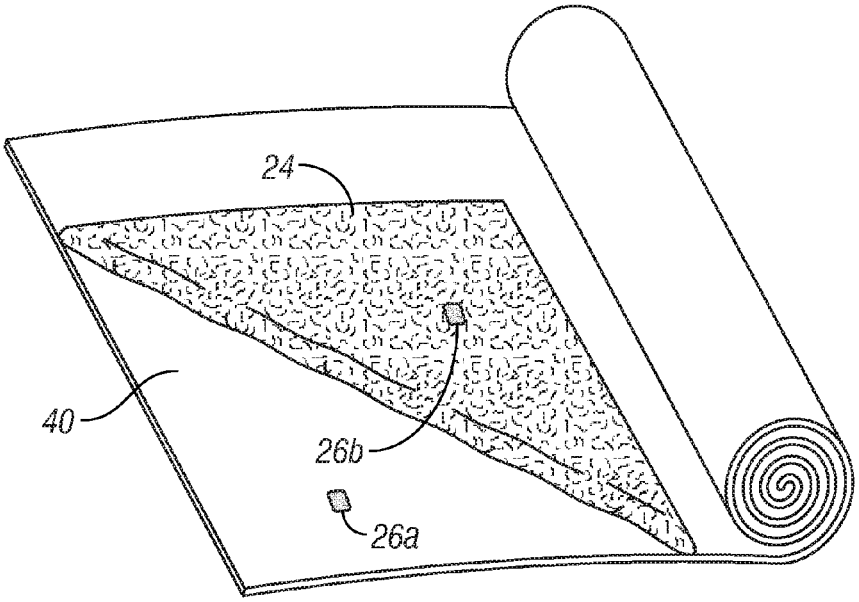
FIG. 3A is a perspective view of a partially rolled yoga mat having a removable upper layer which may comprise fabric or other suitable material, in accordance with the present invention.

As seen in FIGS. 3 and 4, embodiments of the invention wherein the yoga mat has a removable upper layer 24, the yoga mat may comprise a bottom portion 40 formed of a elastomeric polymer or other suitable material, the underside of which will preferably engage an underlying floor surface so as not to slip on the floor surface during use. The connectors 26 comprise first connector members 26*a* on the upper surface of the bottom portion 40 are releaseably engageable with corresponding second connectors 26*b* on the underside of the removable upper surface 24 to firmly hold the upper surface 24 in place on the bottom portion 40 during use. Preferably, the connectors 26 are positioned and constructed so as not to create hard areas, lumps or bumps in the yoga mat 12*a* which would be uncomfortable to or cause interference with the user's performance of yoga on the mat 12*a*. At the same time, however, the connectors 26 will preferably hold the upper surface 24 in place without wrinkling, puckering or sliding of the upper surface 24 relative to the bottom portion 40. In this regard connectors 26 comprising flat adhesive strips or flat strips of hook and loop (Velcro) connector material may be advantageous for this application. In some embodiments, a temporary adhesive may present on all or part of the upper surface of the lower member and/or undersurface of the removable upper member 24 as an alternative to discrete individual connectors 26.

Figure 2B:
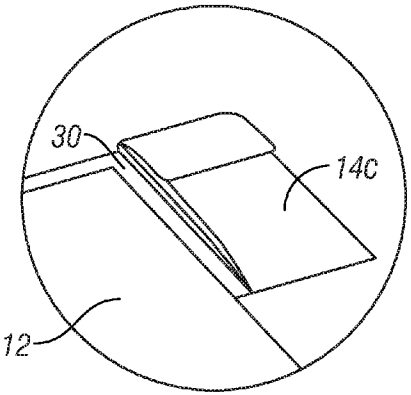
FIG. 2B is a diagram showing an example of a storage compartment attached to a yoga mat by way of a zipper in accordance with the present invention.
Figure 2C:
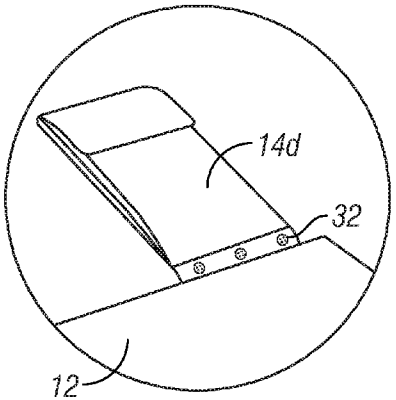
FIG. 2C is a diagram showing an example of a storage compartment attached to a yoga mat by way of buttons in accordance with the present invention.
Figure 2D:
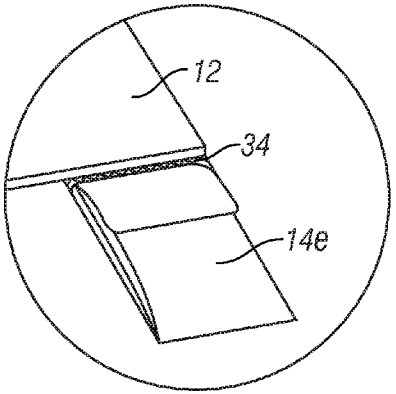
FIG. 2D is a diagram showing an example of a storage compartment sewn or stitched to a yoga mat in accordance with the present invention.
Figure 2E:
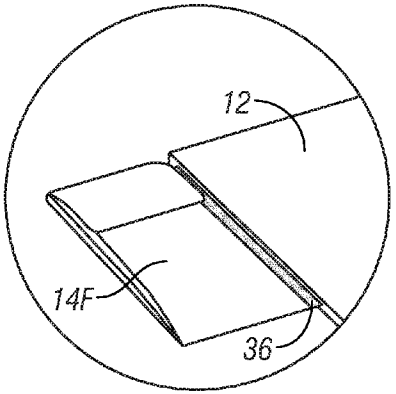
FIG. 2E is a diagram showing an example of a storage compartment attached to a yoga mat by way of hook and loop (Velcro) connection material in accordance with the present invention.

FIGS. 2A through 2E show non-limiting examples of ways in which the storage compartment(s) 14 may be permanently or detachably connected to a yoga mat 12. Specifically, in FIG. 2A a storage compartment 14*b* comprising a pocket with a closure flap is attached to a corner of a yoga mat 12 by snaps 28. In FIG. 2B a similar storage compartment 14*c* is attached laterally to an edge of a yoga mat 12 by a zipper 30. In FIG. 20 a similar storage compartment 14*c* is attached at its bottom end to an edge of a yoga mat by buttons 32. In FIG. 2D, the top end of a similar storage compartment 14*e* is permanently attached to an edge of a yoga mat 12 by a sewn seem or stitching 34. In FIG. 2E a similar storage compartment 14*f* is attached laterally to an edge of a yoga mat 12 by hook and loop fastener material (Velcro) 36. It is to be understood that the ways in which storage compartment(s) 14 may be attached to yoga mats according to the present invention are not limited to only the specific attachment means shown in these examples. Any suitable attachment apparatus or material may be used, including where applicable the following: zippers, buttons, snaps (metallic and plastic), magnets, stitching, sewing, nails, staples, rings such as key rings, hooks; slides, purse feet, swivel hooks, chains such as key chains, hook and eye connectors, dill fashion bubbles, screws, pins, wires, clasps, D-rings, buckles such as vest buckles, nickel eyelets, magnetic snaps, snap eyelets, needles, fork pins, hinges, tacks such as thumbtacks, clips such as bondage clips, paper clips or binder clips, Blutac material, dress pins, notions, thread, ties: yarn, laces, trim, ribbons, safety pins, buckles; snap buckles, knobs, cords, zip ties, tape such as cloth tape, glues such as hot melt glue, fabric glues and adhesives, heat & bond fabrics, gripper snaps, twine, string, rubber bands, heat sink, Velcro dots, Velcro tape, electrically charged surfaces or members that are electrically connected to one another, fasteners, grommets, third hand tools, rubber cement, clear gum, fabric fusion, welding, fusible bias, strap slides and rings, clear straps, cotton and polyester webbing, spiral binding, solder wire, Uhu-glue, dowel, Oxystrap, epoxy resins, masking tapes, duct tapes, gaffe tapes, double-sided tapes, comb bindings, Bodog clips, pushpins, gums such as arabic gum or Tarzan grips. Also, the terms "attached" or "connected" as used in relation to the storage compartment(s) 14 of this invention include forming the storage compartments integrally or continuously with all or part of the yoga mat 12 such that the storage compartment(s) 14 and yoga mat 12 comprise a unitary (e.g., single or integrated) structure which includes the storage compartment(s) 14.

Figure 4A:
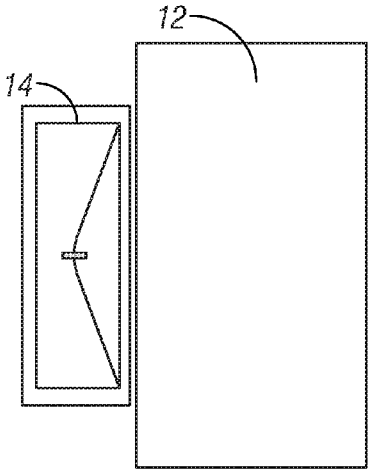
FIG. 4A shows a top view of a yoga mat of the present invention having a storage compartment which comprises a large pouch sized to additionally function as a carrying case for the yoga mat.

FIGS. 4A through 4I show various non-limiting examples of variations in the size, number, location and type of storage compartment(s) used on yoga mats of the present invention. Specifically, FIG. 4A shows a yoga mat 12 with storage compartment 14 wherein the storage compartment 14 comprises sized to additionally function as a carrying case for the yoga mat. Thus, during use of the yoga mat 12, this storage compartment may be attached to one side of the yoga mat 12 as shown and used for storage of ancillary or personal items. After the user has completed a yoga session, the storage compartment may be detached from the mat 12, the mat 12 may be rolled or folded and placed inside the storage compartment 14 so that the storage compartment 14 then acts as a carrying case for the mat 12. In such embodiments where the storage compartment doubles as a carrying case, it may optionally include a handle, shoulder strap or other suitable accessory to facilitate carrying of the article.

Figure 4B:
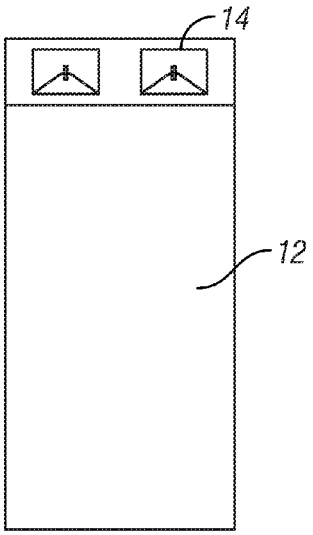
FIG. 4B shows a top view of a yoga mat of the present invention having a plurality of storage compartments on a common base member which is attached to one end of the yoga mat.

FIG. 4B shows yoga mat 12 having a plurality of storage compartments 14 on a common base member which is attached to one end of the yoga mat 12.

Figure 4C:
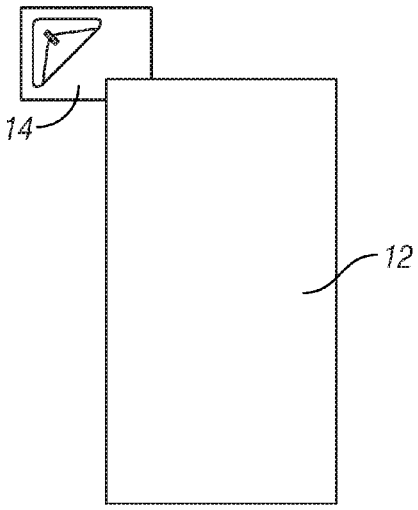
FIG. 4C shows a top view of a yoga mat of the present invention having a storage compartment attached to a corner of the yoga mat.

FIG. 4C shows yoga mat 12 having a single storage compartment 14 attached to a corner of the yoga mat 12.

Figure 4D:
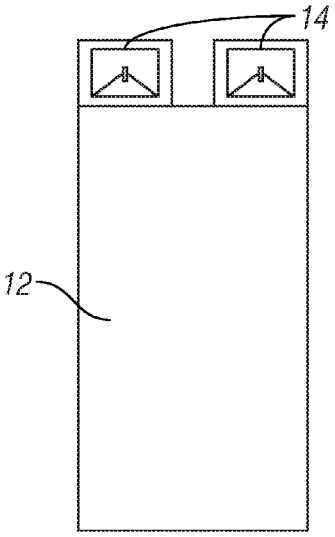
FIG. 4D shows a top view of a yoga mat of the present invention having a plurality of storage compartments mounted on separate base members attached to one end of the yoga may.

FIG. 4D shows a yoga mat 12 having two separate storage compartments 14 attached at separate, spaced-apart locations on one end of the yoga mat 12.

Figure 4F:
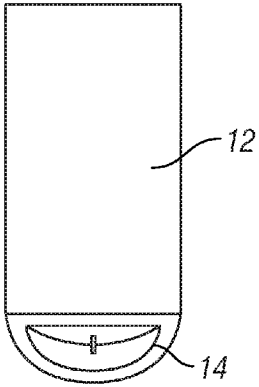
FIG. 4F shows a top view of a yoga mat of the present invention having a non-rectangular storage compartment attached to one end of the yoga mat.
Figure 4E:
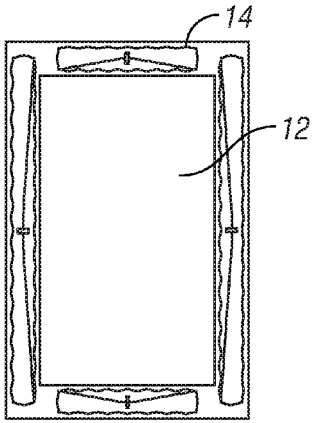
FIG. 4E shows a top view of a yoga mat of the present invention having a storage compartments attached to all four sides of the yoga mat.

FIG. 4E shows a yoga mat 12 having a storage compartments 14 attached to all four sides of the yoga mat.

FIG. 4F shows a yoga mat 12 having a non-rectangular storage compartment 14 attached to one end of the yoga mat 12.

Figure 4I:
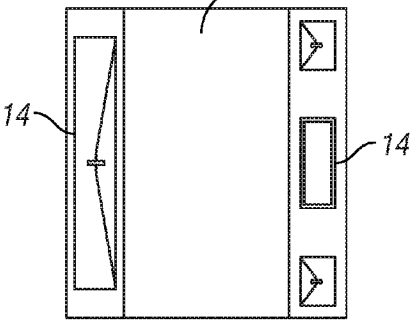
FIG. 4I shows a top view of a yoga mat of the present invention having a plurality of storage compartments attached to opposite sides of the yoga mat, wherein the storage compartments include flexible pouches of varying size as well as a rigid box-type storage compartment.
Figure 4H:
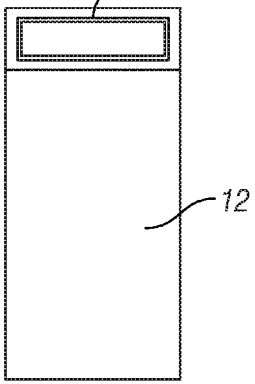
FIG. 4H shows a top view of a yoga mat of the present invention having a rigid box type storage compartment attached to the yoga mat.
Figure 4G:
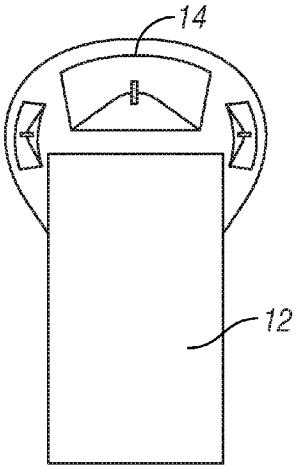
FIG. 4G shows a top view of a yoga mat of the present invention having a plurality of non-rectangular storage compartments attached to one end and portions of the two opposite sides of the yoga mat.

FIG. 4G shows a yoga mat 12 of the present invention having a plurality of non-rectangular storage compartments 14 attached to one end and portions of the two opposite sides of the yoga mat 12.

FIG. 4H shows a yoga mat 12 having a rigid box type storage compartment 14 attached to one end of the yoga mat 12.

FIG. 4I shows yoga mat 12 having a plurality of storage compartments 14 attached to opposite sides of the yoga mat 12, wherein the storage compartments include flexible pouches of varying size as well as a rigid box-type storage compartment.

Figure 5:
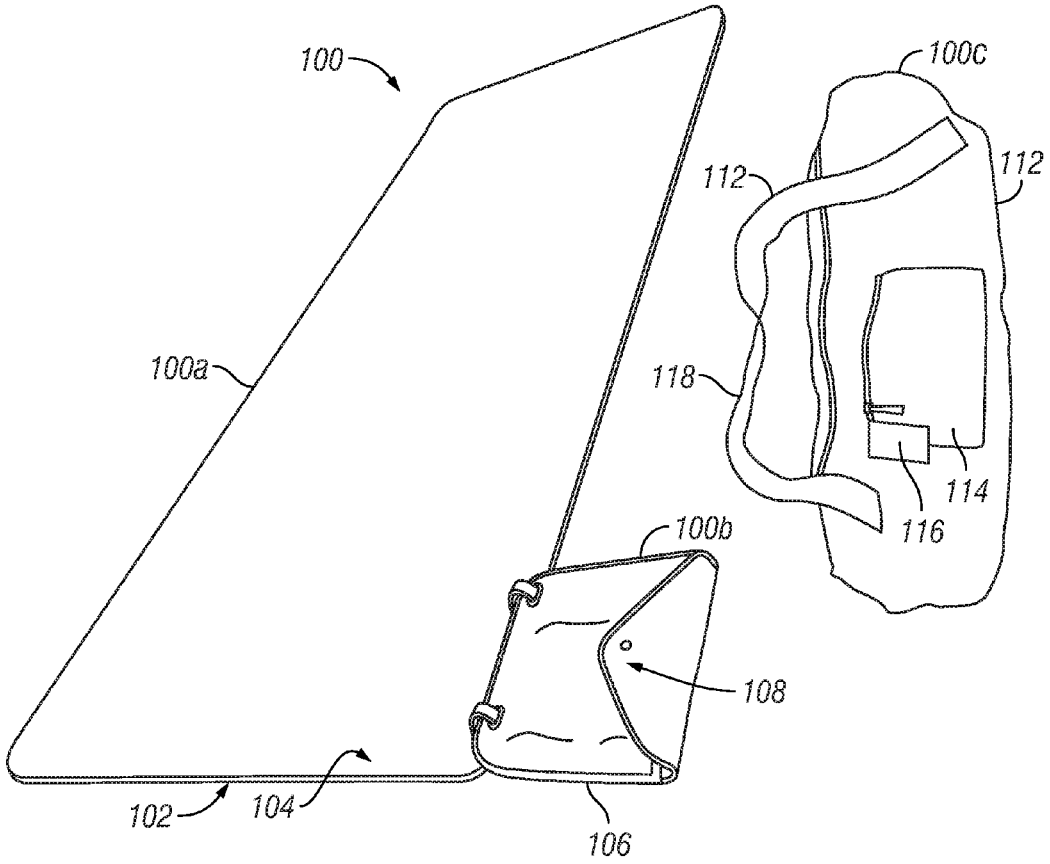
FIG. 5 shows an embodiment of a system comprising a yoga mat, detachable storage compartment and carrying case.

FIG. 5 shows a system 100 which generally comprises a yoga mat 100*a*, a detachable storage compartment 100*b* and a carrying case 100*c*. The yoga mat 100*b* has a bottom surface 102, top surface 104. The yoga mat 100*c* in this system may be any suitable yoga mat, including but not limited to any of the yoga mat embodiments described or shown elsewhere in this patent application.

The detachable storage compartment 100*b* generally comprises a compartment enclosure 106 and an opening 108. In the non-limiting example shown, the compartment enclosure 106 comprises a flexible pouch and the opening 108 comprises an openable and closeable flap, as shown and the opening 108 is directed away from the yoga mat 100*a*, opposite the edge of the compartment enclosure 106 that is attached to an edge of the yoga mat 100*a*. However, it is to be appreciated that the example shown is not limiting. Rather, the detachable storage compartment 100*b* may comprise any other suitable type or embodiment of storage compartment, including but not limited to any of the storage compartment embodiments described or shown elsewhere in this patent application. For example, the storage compartment 100*b* may be attachable to the yoga mat 100*a* by any suitable attachment means, including but not limited to the attachments mentioned or described elsewhere in this patent application. Also, the compartment enclosure may be of any suitable flexible or rigid construction, including but not limited to any of the constructions for storage compartments described or mentioned elsewhere in this patent application. Also, the opening 108 is not necessarily limited to the flap closure type opening shown in FIGS. 5 through 6D, but may be any suitable type of opening having no closure meand or any closure means suitable to hold the opening 108 closed when desired, including but not limited to a zipper, snaps, buttons, hook and loop fattener(s) or any other closure means described or mentioned elsewhere in this patent application.

The carrying case 100*c* of this example comprises a flexible bag or case 112 having an optional handle 118. Optionally, the handle 118 may comprise a strap that is sized to pass over the shoulder of a person who is carrying the carrying case 100*c* and such strap may optionally be provided with a shoulder cushion 112 on a portion of the strap 118 which rests on the person's shoulder. Also, optionally, the carrying case 100*c* may have an optional side pocket 114 and/or optional card or tag holder 116. However, it is to be appreciated that the example shown is not limiting. Rather, the carrying case 100*c* may comprise any type or embodiment of carrying case suitable for the described purpose.

FIGS. 6A through 6D show, in step-wise fashion, one example of a method for using a system of the type shown in FIG. 5.

Figure 6A:
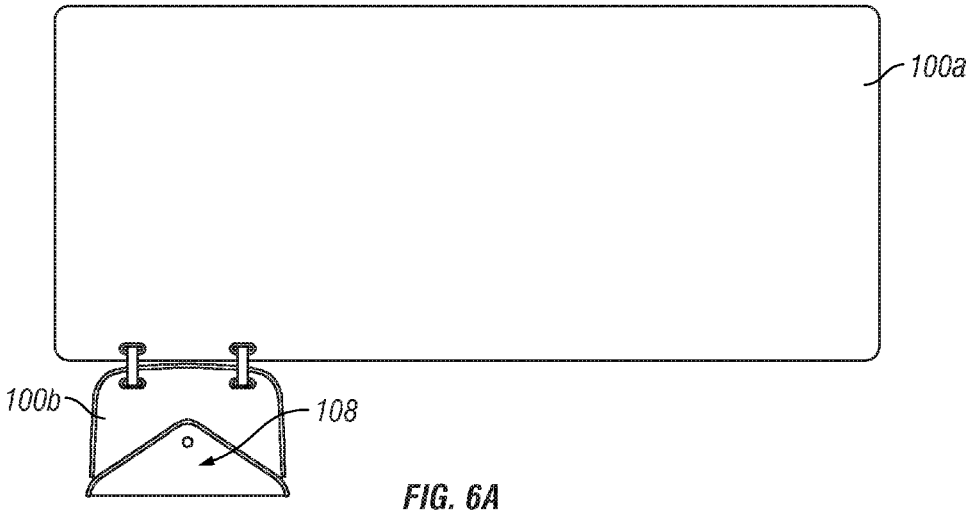
FIGS. 6A through 6D show steps in a method for using the system of FIG. 5.

With reference to FIG. 6A, when is use, the yoga mat 100*a* is deployed such that it lies flat on a floor surface. The carrying case 100*c* has been collapsed and placed inside the storage compartment 100*b* and the storage compartment has been attached to the edge of the yoga mat 100*a* such that the entire storage compartment lies on the flow adjacent to the yoga mat 100*a*. In the embodiment shown, the carrying case 100*c* is flexible such that it may be folded, rolled or generally collapsed and placed within the storage compartment enclosure 106 with the opening 108 in a closed configuration. As described elsewhere in this patent application, sundry or personal items (e.g., keys, glasses, cell phone, etc.) may also be placed inside the storage compartment 100*b*, along with the collapsed carrying case 100*c*. It is to be appreciated that the flexible carrying case shown is merely an example and various other types of caring cases may be used. Indeed, those of skill in the art will understand that various types of flexible or rigid carrying cases may be sufficiently collapsible (e.g., foldable, flexible rollable, compressible, twistable, accordion-like, bellows-like, telescoping, or otherwise collapsible.) such that it will fit inside the detachable storage compartment 100*b*.

Figure 6B:
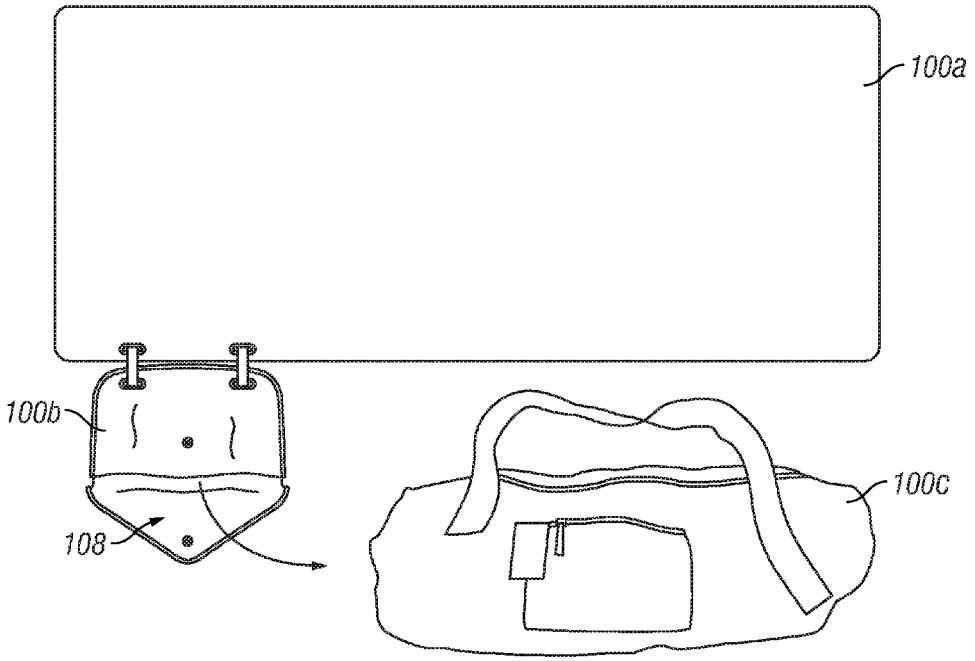

As shown in FIG. 6B, after the user has finished to yoga session, the opening 108 of the storage compartment 100*b* is opened, the carrying case 100*c* is removed from the storage compartment 100*b* and the carrying case is removed and transitioned to a non-collapsed configuration.

Figure 6C:
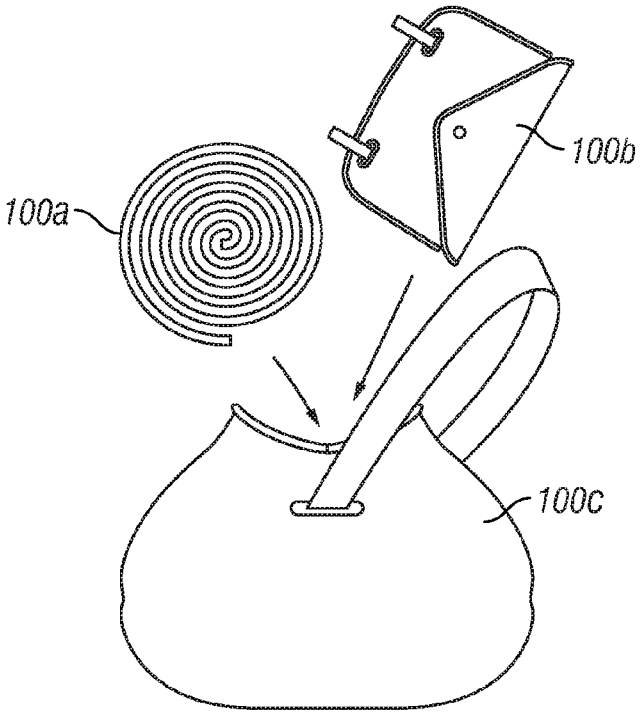

In FIG. 6C the storage compartment 100*b* is optionally detached from the yoga mat 100*a*. Any personal or sundry items (e.g., keys, glasses, cell phone, etc.) that were stored in the carrying case 100*b* may be removed or allowed to remain in the carrying case at the option of the user. The yoga mat is rolled (or alternatively collapsed by other suitable means such as folding) and both the yoga mat 100*a* and detachable storage compartment 100*b* are inserted into the open carrying case 100*c*.

Figure 6D:
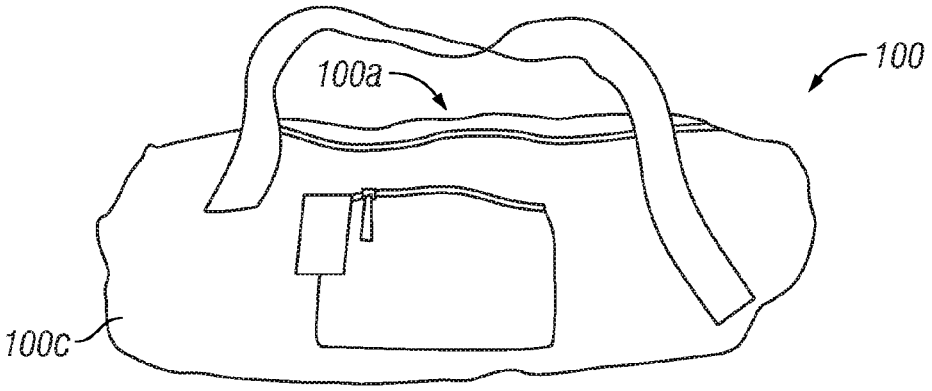

As shown in FIG. 6D the carrying case 100*c* may then be closed if it has a zipper, flap, snaps or other closure apparatus, with the yoga mat 100*a* and storage compartment 100*b* contained inside the carrying case 100*c*. The carrying case 100*c* containing the yoga mat 100*a* and storage compartment 100*b* is then ready to be carried and/or stored by the user.

It is to be appreciated that, although the invention has been described hereabove with reference to certain examples or embodiments of the invention, various additions, deletions, alterations and modifications may be made to those described examples and embodiments without departing from the intended spirit and scope of the invention. For example, any elements, steps, members, components, compositions, reactants, parts or portions of one embodiment or example may be incorporated into or used with another embodiment or example, unless otherwise specified or unless doing so would render that embodiment or example unsuitable for its intended use. Also, where the steps of a method or process have been described or listed in a particular order, the order of such steps may be changed unless otherwise specified or unless doing so would render the method or process unsuitable for its intended purpose. Additionally, the elements, steps, members, components, compositions, reactants, parts or portions of any invention or example described or shown herein may optionally exist or be utilized in the substantial absence of other elements, steps, members, components, compositions, reactants, parts or portions, unless otherwise specified. All reasonable additions, deletions, modifications and alterations are to be considered equivalents of the described examples and embodiments and are to be included within the scope of the following claims.

What is claimed is:

1. A system comprising:

a yoga mat;

a storage compartment; and a carrying case;

wherein the storage compartment is alternately attachable to and detachable from the yoga mat;

wherein the carrying case is alternately deployable in a collapsed configuration or a non-collapsed configuration, and wherein the carrying case is positionable within the storage compartment while the carrying case is in a collapsed configuration;

wherein the yoga mat is alternately deployable in a non-collapsed configuration or a collapsed configuration, and wherein when the yoga mat will lie on a flat surface when the yoga mat is in a non-collapsed configuration and the yoga mat will be positionable in the carrying case, along with the storage compartment, when the yoga mat is in a collapsed configuration;

wherein the storage compartment comprises a flexible compartment enclosure and an opening; and wherein the storage compartment has an edge that is attachable to the yoga mat and the opening of the storage compartment is located on another edge of the storage compartment opposite the edge that attached to the storage compartment.

2. A system according to claim 1 wherein the storage compartment is alternately deployable in a non-collapsed configuration when attached to the yoga mat with the collapsed carrying case positioned therein and a collapsed configuration when positioned in the carrying case along with the yoga mat.

3. A system according to claim 1 wherein the carrying case transitions from a non-collapsed configuration to a collapsed configuration by folding, rolling, compressing, twisting, furling, jumbling, decreasing in length, decreasing in width, or otherwise decreasing in size.

4. A system according to claim 1 wherein the yoga mat transitions from a non-collapsed configuration to a collapsed configuration by folding, rolling, compressing, twisting, furling, jumbling, decreasing in length, decreasing in width, or otherwise decreasing in size.

5. A system according to claim 1 wherein the storage compartment is configured such that, when attached to the yoga mat, the storage compartment lies on a flat surface adjacent to the yoga mat with the opening of the storage compartment directed away from the yoga mat.

6. A method for using a system according to claim 1, said method comprising the steps of:

deploying the yoga mat on a flat surface with the yoga mat in a non-collapsed configuration;

attaching the storage compartment to the yoga mat; and placing the carrying case in a collapsed configuration within the storage compartment.

7. A method according to claim 6 further comprising placing one or more additional items in the storage compartment.

8. A method according to claim 7 wherein at least one of said one or more additional items is/are removed from the storage compartment while the storage compartment is positioned in the carrying case.

9. A method according to claim 7 wherein at least one of said one or more additional items is allowed to remain in the storage compartment while the storage compartment is positioned in the carrying case.

10. A method according to claim 6 further comprising the steps of:

removing the carrying case from the storage compartment;

transitioning the carrying case from a collapsed configuration to a non-collapsed configuration;

transitioning the yoga mat from a non-collapsed configuration to a collapsed configuration; and placing the yoga mat and storage compartment in the carrying case.

11. A method according to claim 10 further comprising the step of:

transporting or storing the carrying case with the yoga mat and storage compartment positioned therein.

12. A method according to claim 6 wherein the storage compartment is also alternately transitionable between a collapsed configuration and a non-collapsed configuration and wherein the storage compartment is in a non-collapsed configuration when attached to the yoga mat and the storage compartment is in a collapsed configuration when positioned in the carrying case.

* * * * *